US009366466B2

(12) United States Patent
Cha

(10) Patent No.: US 9,366,466 B2
(45) Date of Patent: Jun. 14, 2016

(54) AIR CONDITIONER AND METHOD FOR CONTROLLING THE SAME

(71) Applicant: LG ELECTRONICS INC., Seoul (KR)

(72) Inventor: Byoungkeun Cha, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 331 days.

(21) Appl. No.: 13/865,370

(22) Filed: Apr. 18, 2013

(65) Prior Publication Data

US 2013/0298574 A1 Nov. 14, 2013

(30) Foreign Application Priority Data

Apr. 19, 2012 (KR) ..... 10-2012-0041075

(51) Int. Cl.
*F25B 49/00* (2006.01)
*F24F 11/00* (2006.01)

(52) U.S. Cl.
CPC ..... *F25B 49/00* (2013.01); *F24F 11/006* (2013.01); *F24F 2011/0047* (2013.01); *F24F 2011/0075* (2013.01)

(58) Field of Classification Search
CPC ..... F24F 11/006; F24F 2011/0075; F24F 2011/0047; F25B 49/00
See application file for complete search history.

(56) References Cited

U.S. PATENT DOCUMENTS 5,642,857 A * 7/1997 Totsuka ..... F24F 11/0009 236/51
5,718,120 A * 2/1998 Sakurai ..... B60H 1/00978 165/204
5,909,061 A * 6/1999 Sasaki ..... F24F 5/0046 307/44
6,171,185 B1 * 1/2001 Jeong ..... F24F 11/006 237/2 A
7,222,111 B1 * 5/2007 Budike, Jr. ..... G01D 4/004 705/412
7,542,824 B2 * 6/2009 Miki ..... F24F 11/006 236/94
2008/0306632 A1 * 12/2008 Miki ..... F24F 11/006 700/276
2012/0109705 A1 * 5/2012 Belady ..... G06Q 10/06312 705/7.22

* cited by examiner

*Primary Examiner* — Ramesh Patel
(74) *Attorney, Agent, or Firm* — Ked & Associates LLP

(57) ABSTRACT

An air conditioner and a method of controlling the same are provided. The air conditioner and the method analyze a power used pattern according to input power data, compute expected power according to the pattern to dynamically control power, so the power consumption is expected and controlled according to the pattern to stably control a power amount without repeating unnecessary control instead of collective and simple control according to a fixed target. Since an expected amount of the power consumption can be computed, power control is easy and energy consumption is reduced.

11 Claims, 7 Drawing Sheets

AIR CONDITIONER AND METHOD FOR CONTROLLING THE SAME

CROSS-REFERENCE TO RELATED APPLICATION

This application claims the priority benefit of Korean Patent Application No. 10-2012-0041075, filed on Apr. 19, 2012 in the Korean Intellectual Property Office, the disclosure of which is incorporated herein by reference.

BACKGROUND OF THE INVENTION

1. Field of the Invention

The present invention relates to an air conditioner and a method for controlling the same, and more particularly, to an air conditioner which monitors a power consumption amount of an air conditioner or a facility device including the air conditioner to control the air conditioner or a facility device, and a method of controlling the same.

2. Description of the Related Art

An air conditioner is a facility device installed in order to provide more comfortable indoor environment by cleaning indoor air. The air conditioner discharges cool air into an interior of a room to control an indoor temperature. The air conditioner includes an indoor unit composed of a heat exchanger and installed indoors, and an outdoor unit composed of a compressor and a heat exchanger and supplying a refrigerant to the indoor unit.

In recent years, a system where facility devices such as an air conditioner, a ventilation device, a cooling device, and an illumination device to each other by a network are connected and integrally managed has been extended.

Particularly, a network has a tendency to install a facility device including an air conditioner by points in a national chain system and to construct a network such that the facility device is managed.

In recent year, as there is growing interest in a power consumption amount, there is a need to efficiently control power consumption in the summer or winter consuming great power. Accordingly, a demand controller is connected to the air conditioner, so that an operation rate or operation setting of the air conditioner is variably controlled according to power consumption to control the power consumption.

However, there is a great difficulty to systematically manage a plurality of facility devices in a wide area.

Accordingly, there is a demand to systematically and efficiently manage power since the power is collectively controlled according to one set target value.

SUMMARY OF THE INVENTION

The present invention has been made in an effort to solve the above problems, and the present invention provides an air conditioner which computes expected power according to a pattern and controls power by analyzing a used power pattern corresponding to input power data, and a method of controlling the same.

According to an aspect of the present invention, there is provided

According to an aspect of the present invention, there is provided a method of controlling an air conditioner,

BRIEF DESCRIPTION OF THE DRAWINGS

The present invention will become more fully understood from the detailed description given herein below and the accompanying drawings, which are given by illustration only, and thus are not limitative of the present invention, and wherein.

DESCRIPTION OF THE PREFERRED EMBODIMENT

Hereinafter, exemplary embodiments according to the present invention will be described in detail with reference to the accompanying drawings. The present inventive concept may, however, be embodied in many different forms and should not be construed as limited to the example embodiments set forth herein. Rather, these example embodiments are provided so that this description will be thorough and complete, and will fully convey the scope of the present inventive concept to those skilled in the art. The same reference numbers are used throughout the drawings to refer to the same or like parts. Detailed descriptions of well-known functions and structures incorporated herein may be omitted to avoid obscuring the subject matter of the present invention.

Hereinafter, exemplary embodiments according to the present invention will be described in detail with reference to the accompanying drawings.

Figure 1:
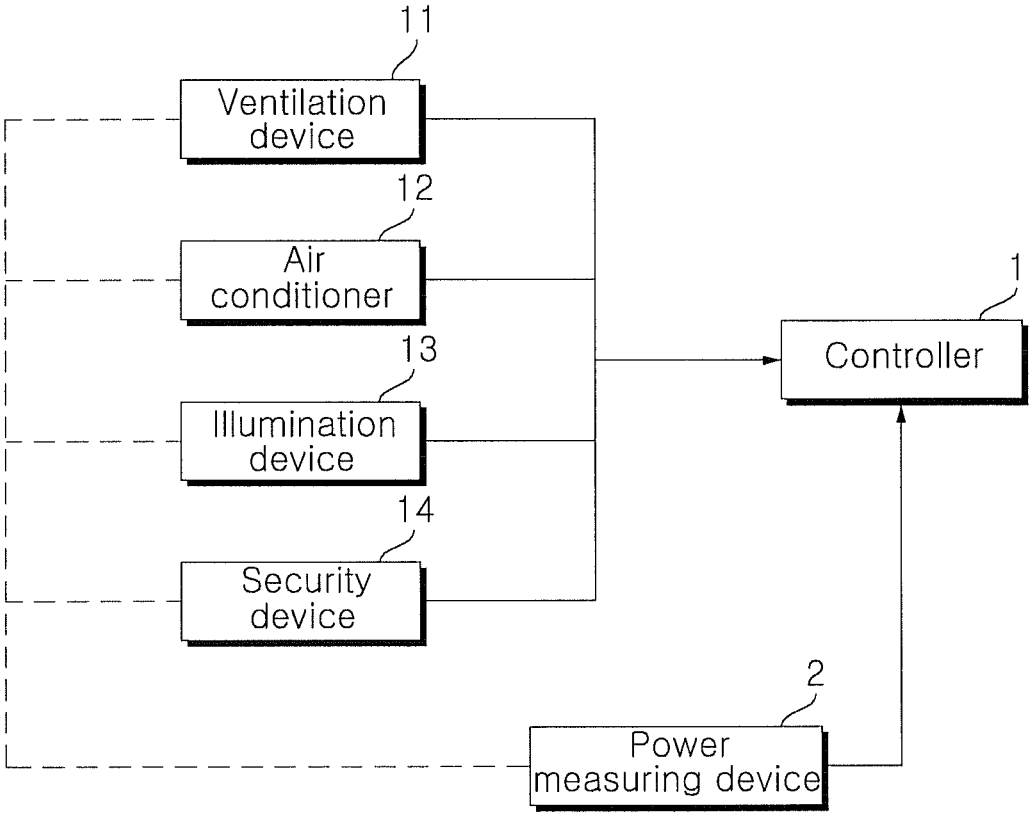
FIG. 1 is a block diagram illustrating configurations of a facility device including an air conditioner and a controller according to an exemplary embodiment of the present invention.

FIG. 1 is a block diagram illustrating configurations of a facility device including an air conditioner and a controller according to an exemplary embodiment of the present invention.

As shown in FIG. 1, an air conditioner includes a ventilation device 11, an illumination device 13, and a security device 14 as well as an indoor unit and an output unit 12, and is connected to a controller 1 and is operatively associated with the controller 1.

The air conditioner further includes a power measuring device 2 measuring a power consumption amount of each facility device.

A plurality of indoor units may condition indoor air and may be simultaneously or independently operated according to an indoor air conditioning load.

The indoor unit includes an indoor heat exchanger (not shown), an indoor fan (not shown), and an expansion valve (not shown) in which a supplied refrigerant is expanded, and a plurality of sensors (not shown). The outdoor unit includes a compressor (not shown) receiving a refrigerant and compressing, an outdoor heat exchanger (not shown) heat-exchanging the refrigerant with outdoor air, an accumulator (not shown) extracting gas refrigerant from the supplied refrigerant and providing the extracted gas refrigerant to the compressor, and a 4-way valve (not shown) selecting a flow passage of the refrigerant according to a heating operation.

A least one illumination device 13 is provided and is controlled by a connected switch to brighten an interior of a room.

The ventilation device 11 introduces outdoor air in conjunction with the indoor unit and the outdoor unit and discharge indoor air to the outside such that air circulates.

The security device 14 monitors entrance from the outside and monitors illegal intrusion to output alarm.

The air conditioner may include a unit such as an air cleaner, a humidifier, and a dehumidifier as well as the ventilation device, the indoor unit and the outdoor unit. However, a following description will be made on the assumption that the indoor unit and the outdoor unit are installed by way of example. The number of indoor units and outdoor units is not limited the drawings.

If a plurality of facility devices is installed inside a building, the power measuring device 2 measures power amounts consumed in the facility devices and outputs the measured power amounts to the controller 1.

The controller 1 controls operation setting with respect to the facility devices, monitors operations of the facility devices, and controls an operation of the facility device according to a power amount inputted from the power measuring device 2.

The following description will be made on the assumption that the facility deice is controlled by controlling setting and power consumption of the controller. When a plurality of air conditioners is connected so that a plurality of controllers is connected to a remote controller, the remote controller may control the facility device.

Figure 2:
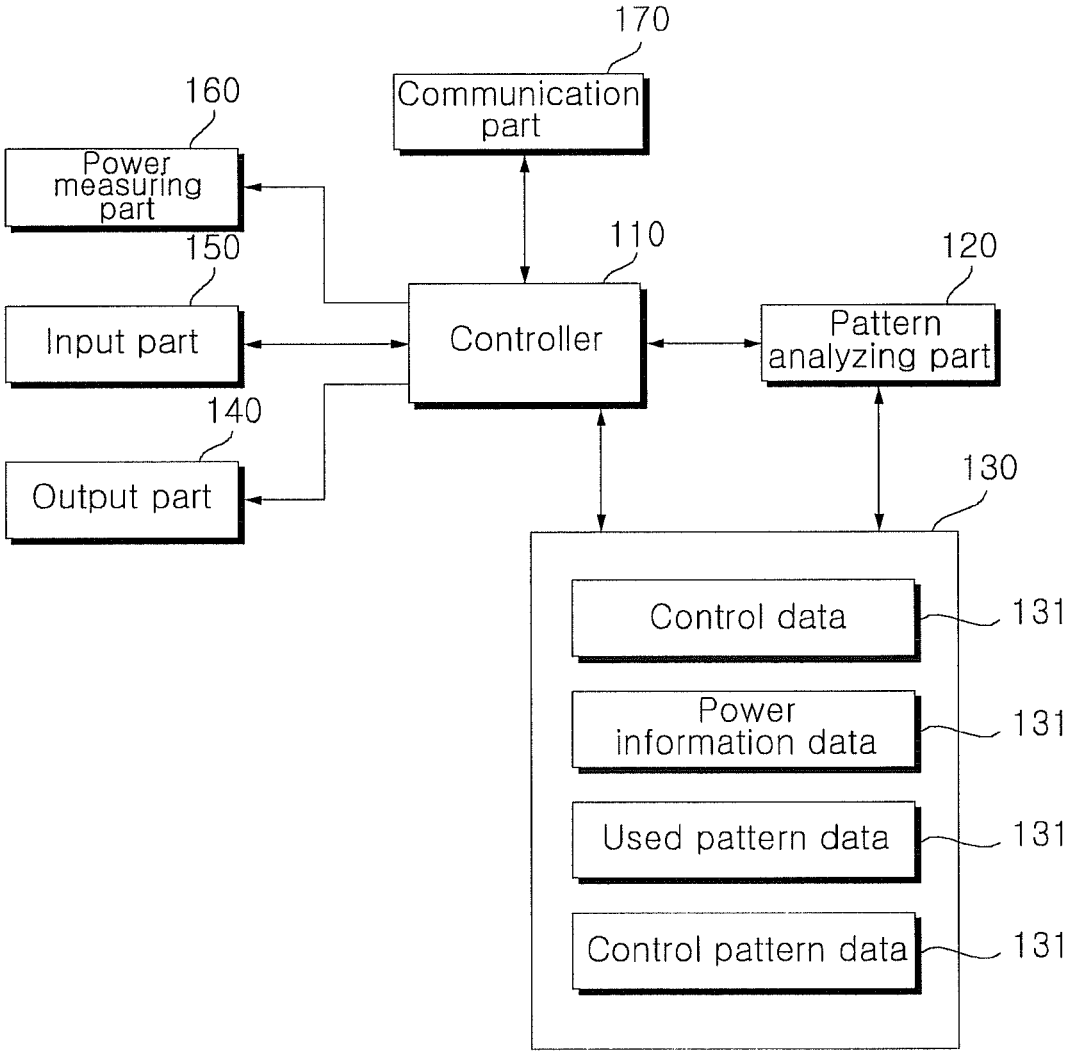
FIG. 2 is a block diagram illustrating a configuration of a controller according to an exemplary embodiment of the present invention.

FIG. 2 is a block diagram illustrating a configuration of a controller according to an exemplary embodiment of the present invention.

Referring to FIG. 2, the controller 1 includes a power measuring part 160, an input part 150, an output part 140, a communication part 170, a pattern analyzing part 120, a data part 130, and a control part controlling an overall operation of the controller 1.

The input part 150 includes at least one button and switch, receives a control command with respect to each facility device, and provides the received control command to the control part 110.

The output part 140 outputs data with respect to an operation state of each facility device, outputs a control interface with respect to each facility device, and outputs a specific effect sound and alarm sound in some cases.

The data part 130 stores control data 131 with respect to a facility device such as an indoor unit, an outdoor unit, an illumination device, a ventilation device, and a security device, power data 132 with respect to power consumption, and control pattern data set according to a used pattern.

The power measuring part 160 is connected to the power measuring device 2 and receives power consumption data from the power measuring device 2. The power measuring part 160 acts as the power measuring device.

The control part 110 generates and transmits a control command for the indoor unit, the outdoor, the illumination device, a ventilation device, and the security device according to a command inputted from the input part 150 or a command received through the communication part 170 to control operations of the indoor unit, the outdoor, the illumination device, a ventilation device, and the security device.

The control part 110 receives a measured power amount from the power measuring part 160 to analyze a power consumption amount of each device, and collects information with respect to an operation state of each device.

The control part 110 transmits operation information of devices and power consumption information to a central server through the communication unit 170. The controller 110 may receive an internal temperature, an external temperature, and a humidity of a point measured by a plurality of sensors (not shown).

The control part 110 may control devices according to power consumption by devices. The control part 110 controls an operation of each device according to a pattern according to power consumption.

The pattern analyzing part 120 analyzes accumulated and stored data associated with measured power consumption of the facility device and extracts a pattern with respect to power consumption based on a predetermined time.

For example, after accumulating power consumption data, the pattern analyzing part 120 analyzes whether there is a predetermined pattern for each one day to extract a pattern. That is, in a case of the summer, the pattern analyzing part 120 extracts a pattern in which cooling setting temperatures of the indoor unit and the outdoor unit are increased from 12 a.m. and are reduced at 5 p.m. and is turned-off at the evening time.

In this case, the pattern analyzing part 120 may extract a used pattern with respect to one day, one week, one month, and one year based on accumulated data.

The control part 110 expects a power consumption amount for one day according to the extracted pattern.

That is, if a target amount for one month is set, the control part 110 may compute an expected power amount based on a target amount and a current power consumption amount. However, as described above, when power consumption is increased in the daytime, the expected power amount may exceed a target amount of one month based on a power consumption amount in the daytime. However, a pattern where power consumption is reduced is indicated in the evening time and does not continuously maintain, but is reduced in the evening time. Accordingly, the controller 110 does not instantly perform limitation control in consideration of this but controls power consumption in the daytime in consideration of power consumption reduced amount in the evening time too.

Figure 3:
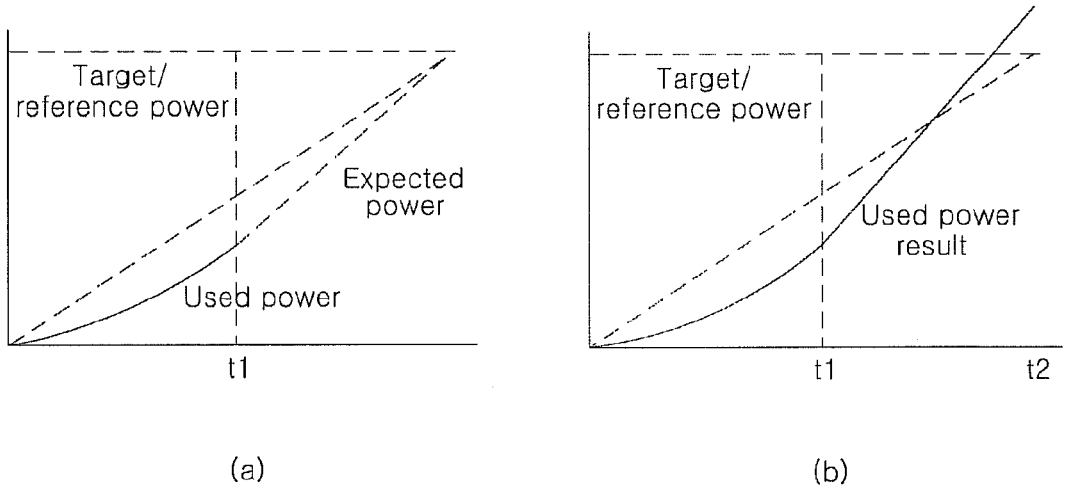
FIG. 3 is a diagram illustrating expected power according to a predetermined target and power variation according to control according to an exemplary embodiment of the present invention.

FIG. 3 is a diagram illustrating expected power according to a predetermined target and power variation according to control according to an exemplary embodiment of the present invention.

If a target amount with respect to power consumption is set, as shown in FIG. 3(*a*), next expected power with respect to the power consumption may be computed based on a power consumption amount at time point t1.

In this case, if the same power amount is consumed every data, power consumption is increased constantly. Since the power consumption is changed according to weather variation or the like, the control part controls such that the expected power is computed according to an existing used amount and a current moment power consumption amount not to exceed target power.

As shown in FIG. 3(*b*), power consumption is stably performed. As described above, even if the expected power is computed and controlled, when used amounts of the indoor unit and the outdoor unit are increased due to sudden sultriness, used power may exceed target power at a time point t2.

Meanwhile, when a power used amount is initially excessive, the power consumption is restricted in advance. In this case, only small power may be consumed not to reach a real target amount by excessively restricting next power consumption.

In a case of simple control according to an existing target amount, power consumption is initially excessive and is excessively restricted in the later half which may cause convenience of a user.

To control setting the power target amount deepens on a point in that a fee with respect to power consumption associated with large power consumption is determined in advance. Even if a target amount is not entirely used, a power fee is determined based on the foregoing point. When the target amount is exceeded, since an addition fee corresponding to an exceeded amount is great, it is preferable to suitably adjust the power consumption.

Accordingly, a case of controlling power consumption by extracting a used pattern is as follows.

Figure 4:
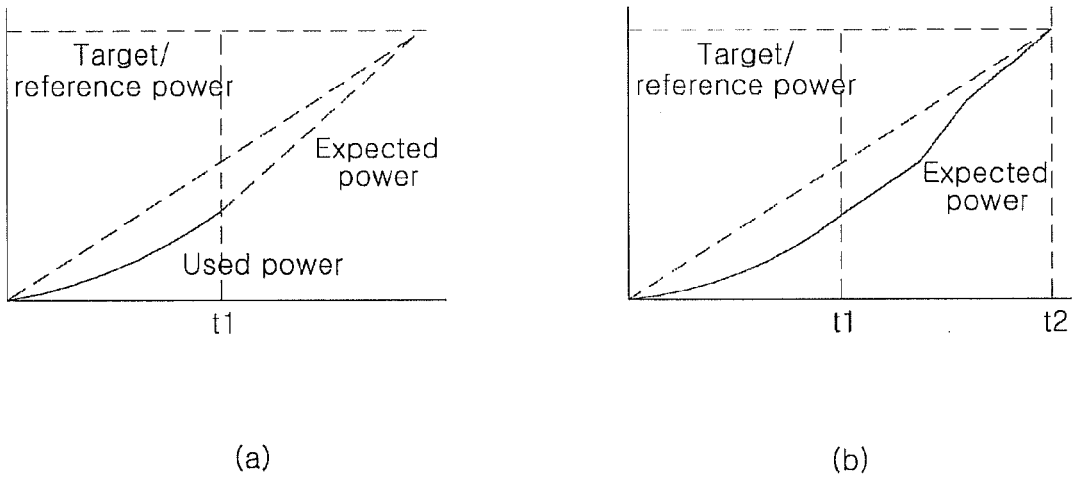
FIG. 4 is a diagram illustrating expected power through pattern analysis and power variation according to control according to an exemplary embodiment of the present invention.

FIG. 4 is a diagram illustrating expected power through pattern analysis and power variation according to control according to an exemplary embodiment of the present invention.

As shown in FIG. 4(*a*), even if the expected power is computed based on used power of t1 with respect to target power, a used pattern with respect to power consumption is extracted and corresponding control is performed so that the used power may be controlled as shown in FIG. 4(*b*).

That is, even if the power consumption is initially excessive, the power consumption is controlled in consideration of a next used pattern according to a pattern without rapidly limiting the power consumption. Even if the power consumption is small at the early stage, when a next used pattern is increased, the power consumption is controlled in advance not to exceed a target amount.

Figure 5:
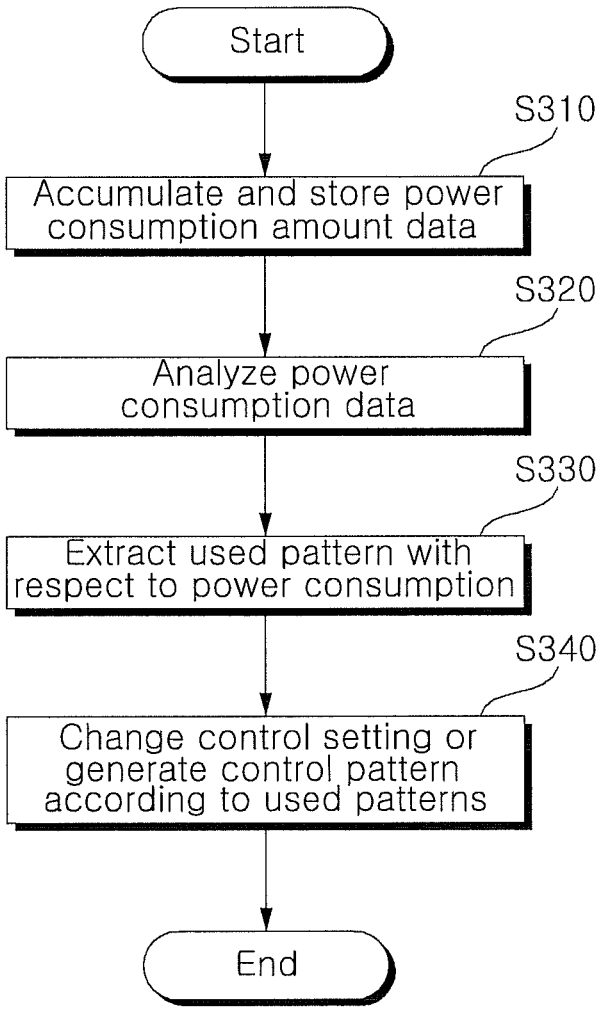
FIG. 5 is a flowchart illustrating a method of analyzing power data according to an exemplary embodiment of the present invention.

FIG. 5 is a flowchart illustrating a method of analyzing power data according to an exemplary embodiment of the present invention.

Referring to FIG. 5, a power measuring part 160 measures a power consumption amount with respect to a facility and outputs the measured power consumption amount to a control part 110, the control part 110 accumulates and stores data with respect to the power consumption amount in a data part (S310). In this case, the control part 110 may accumulate and store the power consumption amount data according to a type of facility device.

As the power consumption data of the facility device are accumulated, a pattern analyzing part 120 analyzes power consumption data (S320).

The pattern analyzing part 120 extracts a used pattern with respect to power consumption of each facility device or entire facility devices (S330). The pattern analyzing part 120 may extract a used pattern with respect to the power consumption for each day, week, month, and year according to an accumulated degree of the data.

When the used patterns are extracted, the control part 110 changes control setting with respect to the facility device or generates a control pattern to control the facility device according to the used patterns (S340).

Figure 6:
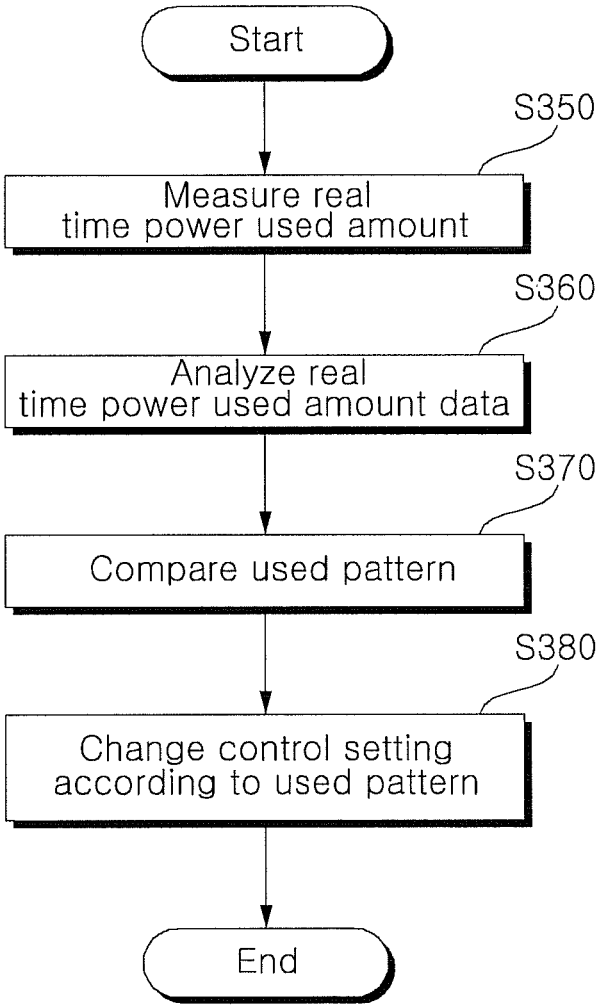
FIG. 6 is a flowchart illustrating a setting method according to a used power pattern according to an exemplary embodiment of the present invention.

FIG. 6 is a flowchart illustrating a setting method according to a used power pattern according to an exemplary embodiment of the present invention.

Referring to FIG. 6, a power measuring part 160 measures and outputs a real time power used amount of a facility device (S350).

A pattern analyzing part 350 analyzes input real time power used amount data to extract a pattern (S360).

The pattern analyzing part 350 compares the extracted used pattern with an extracted and stored used Patten (S370).

The pattern analyzing part 350 provides a comparison result to the control part 110. Because current control setting is performed based on an existing used pattern, when a newly extracted used pattern consumes excessive power than that of an existing used pattern, the control part 110 changes control setting according to the newly extracted used pattern (S380). In this case, the control part 110 may generate and set a control pattern according to the used pattern.

For example, when a used pattern is increased in the daytime and is reduced in the night time, in control of the facility device, the control part 110 may designate a schedule to set a control pattern such that a setting temperature is limited less than a predetermined temperature in the daytime and the setting temperature is controlled to an input temperature in the night time, or the facility device are alternately operated in a predetermine order in the daytime.

In this case, the control pattern may be set based on power consumption data. That is, when the power actually consumed through control of a setting A and the power actually consumed through control of a setting B, the setting may be controlled to be changed based on the power to be consumed.

That is, when A setting is controlled and really consumed power is 50 and A setting is controlled and the really consumed power is 30, setting is changed and controlled based on a power amount to be consumed.

Figure 7:
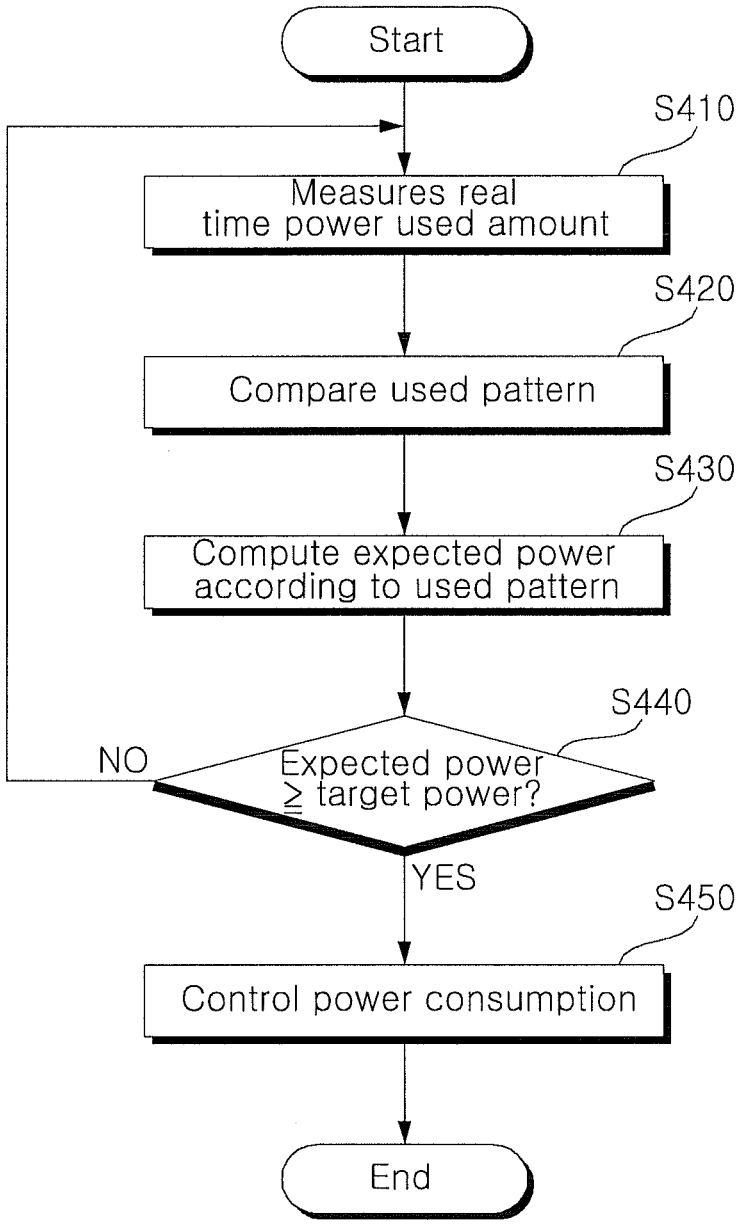
FIG. 7 is a flowchart illustrating a control method according to a used power pattern according to an exemplary embodiment of the present invention.

FIG. 7 is a flowchart illustrating a control method according to a used power pattern according to an exemplary embodiment of the present invention.

Referring to FIG. 7, a power measuring part 160 measures a real time power used amount of a facility device and outputs the measured real time power used mount to a pattern analyzing part 120, the pattern analyzing part 120 extracts and compares a corresponding used pattern (S420).

In this case, the control part 110 computes expected power according to the used pattern (S430).

The control part 110 determines whether the expected power according to the used pattern is equal to or greater than target power (S440). When the expected power according to the used pattern is less than the target power, the control part 110 maintains a current state. When the expected power according to the used pattern is equal to or greater than target power, the control part 110 controls power consumption (S450).

Even if a moment power consumption amount is increased and an expected consumption amount according to the moment power consumption amount is equal to or greater than a target power amount, when the expected power consumption amount according to a used pattern is less than the target power amount, the control part 110 maintains an operation of the facility device. In a case where the moment power consumption amount is reduced and an expected consumption amount according to the moment power consumption amount is less than the target power amount, when the expected power consumption amount according to the used pattern is equal to or greater than the target power amount, the control part 110 may control a restricted operation of the facility device.

In a case where the moment power consumption amount is increased, when it is expected that a power consumption amount is reduced for a predetermined next time according to a used pattern, the controller 110 maintains an operation of the facility device. When it is expected that the power consumption amount is increased for a predetermined next time, the control part 110 controls a restricted operation of the facility device.

Figure 8:
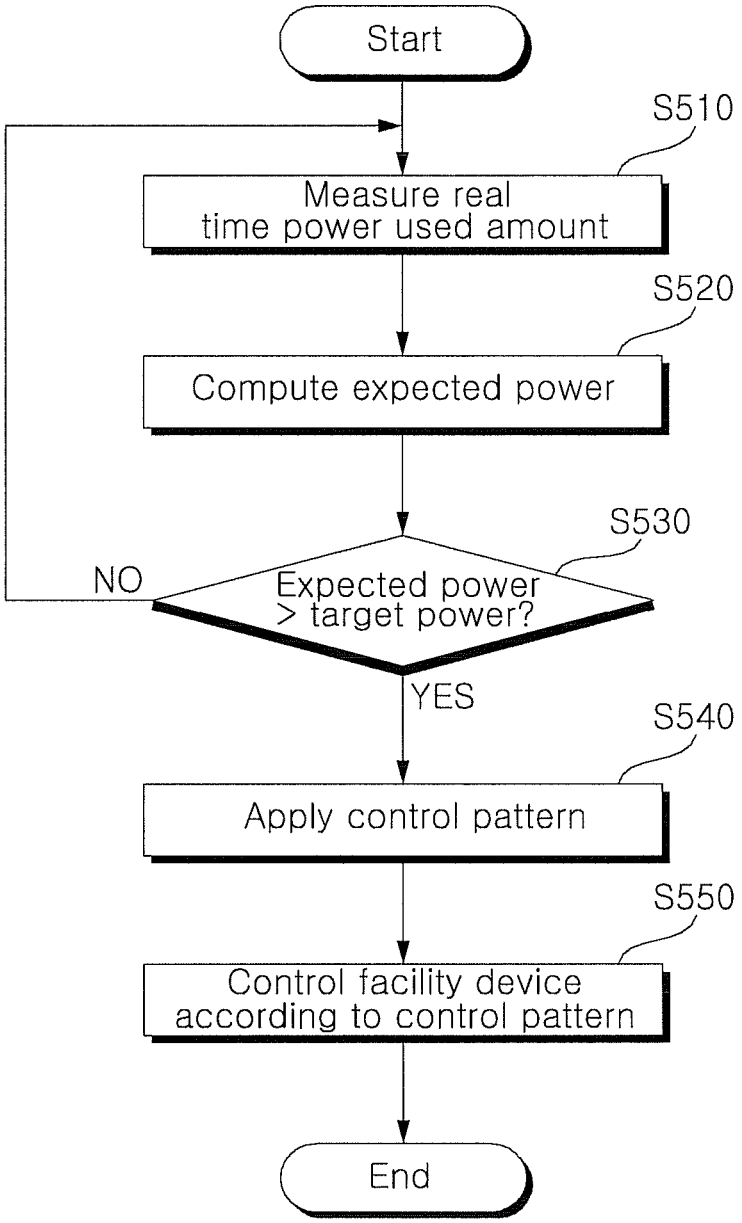
FIG. 8 is a flowchart illustrating a method of applying a control pattern according to a used power pattern according to an exemplary embodiment of the present invention.

FIG. 8 is a flowchart illustrating a method of applying a control pattern according to a used power pattern according to an exemplary embodiment of the present invention.

Referring to FIG. 8, a power measuring part 160 measures a real time power used amount of a facility device and outputs the measured real time power used amount (S510). When a pattern analyzing part 120 extracts a used pattern, a control part 110 computes expected power according to the used pattern (S520).

In this case, the control part 110 determines whether the computed expected power exceeds target power (S530). When the computed expected power exceeds the target power, the control part 110 applies a control pattern capable of reducing power consumption of a facility device (S540).

As described above, when the power consumption is controlled to be a predetermined value or less, information on the power consumption according to a specific setting is obtained from the power consumption data, a setting value is changed based on the power consumption reversely.

A schedule according to an operation of the facility device is set and the facility device is restrictively operated to be applicable to a control pattern.

Control setting for limiting power consumption may set a control pattern in units of days, weeks, and months.

The control part 110 controls a facility device according to the control pattern (S550).

Accordingly, the present invention does not control an operation of the facility device according to a current moment power consumption amount but can control power consumption according to the used pattern by extracting the used pattern of the power consumption for a predetermined period.

When the pattern is changed, a new used pattern is extracted and applied so that power consumption may be efficiently controlled.

Accordingly, efficient control is possible such that the power consumption does not exceed target power while minimizing inconvenience for the user.

The air conditioner and the method of controlling the same according to the present invention analyze a power used pattern according to input power data, compute expected power according to the pattern to dynamically control power, so the power consumption is expected and controlled according to the pattern to stably control a power amount without repeating unnecessary control instead of collective and simple control according to a fixed target. Since an expected amount of the power consumption can be computed, power control is easy and energy consumption is reduced.

The embodiment of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An air conditioner system, comprising:

a plurality of facility devices including an air conditioner, an illumination device, a security device, a ventilation device, and an electric device;

a power measuring device that measures a power consumption amount of each of the plurality of facility devices; and a controller that accumulates and stores power amount information received from the power measuring device, and computes expected power according to a use pattern and target power by analyzing the power amount information to control each of the plurality of facility devices, wherein the controller analyzes the power amount information received from the power measuring device to extract the use pattern according to power consumption with respect to each of the plurality of facility devices and controls each of the plurality of facility devices such that the expected power is computed according to the use pattern, an existing use amount, and a current power consumption amount not exceeding the target power.

2. The air conditioner system of claim 1, wherein the controller computes the use pattern, which repeats for a predetermined period of time based on the power amount information.

3. The air conditioner system of claim 2, wherein the controller includes a pattern analyzer that analyzes the power amount information to model a next operation of each of the plurality of facility devices, and computes the use pattern with respect to the operation of each of the plurality of facility devices over time.

4. The air conditioner system of claim 3, wherein the controller constructs a simulation module with respect to the computed use pattern to compute an expected amount and an expected fee of power consumption for a predetermined period of time.

5. The air conditioner system of claim 1, wherein the controller includes a control part that computes expected power with respect to the power consumption amount of each of the plurality of facility devices corresponding to the use pattern to control the plurality of facility devices.

6. The air conditioner system of claim 1, wherein the plurality of facility devices, the power measuring device, and the controller are connected via a network.

7. The air conditioner system of claim 1, wherein the controller includes an input to receive control commands for the plurality of facility devices.

8. The air conditioner system of claim 1, wherein the controller includes an output to output an operation state of the plurality of facility devices.

9. The air conditioner system of claim 1, wherein the controller includes a data storage to store the power amount information.

10. The air conditioner system of claim 1, wherein the controller includes a power measuring part to receive the power amount information from the power measuring device.

11. The air conditioner system of claim 1, wherein the controller includes a communication device to transmit operation information of the plurality of facility devices and the power amount information to a central server.

* * * * *